United States Patent [19]

Tkach et al.

[11] 4,114,700

[45] Sep. 19, 1978

[54] PNEUMATIC APPARATUS OF THE PERCUSSIVE TYPE

[76] Inventors: Khaim Berkovich Tkach, ulitsa Gogolya, 17, kv. 49; Alexandr Dmitrievich Kostylev, ulitsa Derzhavina, 19, kv. 44; Konstantin Stepanovich Gurkov, ulitsa Derzhavina, 19, kv. 13; Boris Nikolaevich Smolyanitsky, ulitsa O.Dundicha, 27, kv. 18; Vladimir Dmitrievich Plavskikh, ulitsa Gogolya, 233/1, kv. 34; Vladimir Petrovich Boginsky, ulitsa Lenina, 59, kv. 58, all of Novosibirsk, U.S.S.R.

[21] Appl. No.: 782,100

[22] Filed: Mar. 28, 1977

[51] Int. Cl.[2] ..... E21B 11/02

[52] U.S. Cl. ..... 175/19; 91/19; 91/32; 91/234; 173/91; 173/137

[58] Field of Search ..... 175/19, 305; 173/137, 173/91; 91/32, 19, 234, 277

[56] References Cited

U.S. PATENT DOCUMENTS

| | | | |
|---|---|---|---|
| 998,477 | 7/1911 | Duval | 91/20 |
| 1,965,064 | 7/1934 | Zwayer | 91/277 X |
| 3,924,690 | 12/1975 | Shaw | 173/115 X |
| 3,952,813 | 4/1976 | Chepurnoi | 173/91 |
| 3,995,702 | 12/1976 | Klimashko | 173/91 |

*Primary Examiner*—Ernest R. Purser
*Assistant Examiner*—William F. Pate, III
*Attorney, Agent, or Firm*—Lackenbach, Lilling & Siegel

[57] ABSTRACT

The apparatus has a pointed-nose hollow cylindrical body with a closed rear portion. Disposed inside the body, so as to enable reciprocation and rotation about the axis of the body, is a stepped striker which can be locked against rotation about the axis of the body in two positions, the positions corresponding to forward and reverse movement of the apparatus.

For the purpose of admitting compressed air into a forward working chamber, the striker is provided with a central passage permanently connected to a rear working chamber and at least two radial passages which provide communication between the central passage and an outer cylindrical surface of a large step of the striker. The radial passages are displaced relative to each other both circumferentially and longitudinally along the axis of the body. The body is provided with grooves in an inner surface of its forward portion which define, in conjunction with the outer cylindrical surface of the large step of the striker, passages arranged so that one of the radial passages of the striker is connected to them when the striker is in one of the locked positions.

For the purpose of discharging air from the forward working chamber into the atmosphere, the striker is provided with longitudinal grooves in the outer surface of its large step within the forward portion which define, in conjunction with the body, passages opening into the forward working chamber, the body being provided with ports which recurrently connect the forward working chamber to the atmosphere through these passages.

6 Claims, 26 Drawing Figures

PNEUMATIC APPARATUS OF THE PERCUSSIVE TYPE

FIELD OF THE INVENTION

The present invention relates to pneumatic apparatus of the percussive type for driving holes and, more specifically, to pneumatic apparatus of the percussive type for driving holes in the ground by compacting same. The apparatus disclosed may find utility, for example, in laying buried lines under highways, streets and runways by what is known as the ditchless method or for driving steel pipes and other structures into the ground.

BACKGROUND OF THE INVENTION

Known in the art is a similar pneumatic apparatus of the percussive type featuring a pointed-nose hollow cylindrical body, the back of which is closed by a special nut. Disposed in the body for reciprocation by the action of compressed air is a striker with a central passage and radial passages which admit and discharge air. The task of distributing air in the apparatus is performed by a pipe connected to a source of compressed air. The pipe is inserted into the central passage and is connected to the nut by means of a shock absorber so as to enable displacement axially with respect to the body. The striker forms in conjunction with the body and the pipe a rearward working chamber permanently connected to the source of compressed air, a forward working chamber recurrently connected to the rearward working chamber and to the atmosphere and an exhaust chamber permanently connected to the atmosphere. When the apparatus is set to advance, i.e., to drive a hole, the striker reciprocates due to the action of compressed air and strikes against the forward portion of the body, thus causing it to move forward. The friction force coming into play between the surface of body and the ground counteracts the reaction force and prevents the apparatus from moving backward.

For reversing the direction of travel of the apparatus in the hole, the pipe is displaced axially by a certain amount reversely to the direction of the advance of the apparatus. This will advance the instant of admitting air into the forward working chamber and retard the instant of its discharge therefrom with the result that the striker will deliver its blows against the nut and not against the forward portion of the body as during the advance. Yielding to said blows, the apparatus will reverse from the hole.

The known apparatus, incorporating the pipe with the resilient means of securing it in the body, suffers from a number of disadvantages such as intricate construction, low reliability; short service life of the apparatus and, considerable labor requirements for fabrication.

Free from these disadvantages are those apparatus where the distribution of air is effected by means of the striker and body alone without a recourse to some additional air-distributing contrivances. This applies, for example, to the apparatus disclosed in a Belgic Pat. No. 816,991 which consists of a pointed-nose hollow cylindrical body closed at the back in which there is disposed for reciprocation due by the action of compressed air a stepped striker having a large step facing the forward portion of the apparatus; a central passage and at least one radial passage. The striker, in conjunction with the body, forms a forward working chamber recurrently connected to a source of compressed air and to the atmosphere for discharging air and forms a rearward working chamber permanently connected to the source of compressed air. In addition, the striker is provided with the possibility of being locked in a positions relative to the body so as to be unanle to rotate about its axis and it forms a space bound by an end face of the large step, a cylindrical surface of a small step and the body.

The disadvantage of this apparatus is its inability to travel in reverse.

SUMMARY OF THE INVENTION

It is an object of the present invention to provide a pneumatic apparatus of the percussive type for driving holes in the ground by compacting same which has a simple design, reliable operation, a long service life, low labor requirements for its manufacture and the ability to travel in reverse.

These and other objects are attained by an apparatus of the percussive type for driving holes in the ground by compacting same consisting of a pointed-nose hollow cylindrical body with a closed back. Disposed wherein the body for reciprocation by the action of compressed air is a stepped striker which defines, in conjunction with the body, a forward working chamber recurrently connected to a soruce of compressed air and to the atmosphere and a rear working chamber permanently connected to the source of compressed air. The striker is provided with a central passage communicating with the rear working chamber and at least one radial passage opening into the central passage and onto an outer cylindrical surface of a large step of the striker. The stricker is disposed so it may be locked so as to be incapable of rotating about the axis of the body in a positions relative to the body corresponding to the advance of the apparatus. A space bound by a rear end face of the large step of the striker, a cylindrical surface of a small step of the striker and by the body is provided. In accordance with the invention, the striker is disposed for rotation about the axis of the body and for locking, on being turned about the axis of the body, in a second position corresponding to backward movement of the apparatus. Longitudinal grooves are provided in the outer surface of the large step which define passages in conjuction with the body through which are escapes from the forward working chamber. At least one additional radial passage opening into the central passage and onto the outer cylindrical surface of its large step is provided, the radial passages being displaced relative to each other both circumferentially and longitudinally along the axis of the body. The body is provided with grooves in an inner surface of its forward portion which form passages in conjunction with the outer cylindrical surface of the striker through which air is introduced into the forward working chamber, the passages being so arranged that one of the radial passages of the striker is connected to one of the passages when the striker is in one of the locked positions. Ports are provided in the side wall of the body at a rear portion between the radial passages of the striker to enable spent air to escape from the forward working chamber.

An apparatus designed in accordance with these principles is capable of travelling in reverse, and is more simple, reliable and durable than the known reversible pneumatic apparatus of the percussive type.

Disclosed herein is another embodiment of the present invention wherein the striker is disposed for rotation about the axis of the body and for locking, on being turned about the axis of the body, in a second position corresponding to backward movement of the apparatus, and is provided with longitudinal grooves in the outer surface of its large step which form passages in conjunction with the body through which air escapes from the forward working chamber. The body is provided with grooves of unequal length in an inner surface of its forward portion which form longitudinal passages of unequal length in conjunction with an outer cylindrical surface of the step of the striker into the forward working chamber through which air is introduced, these passages alternating along the circumference so that the radial passage opens into the longitudinal passages of unequal length when the striker is in one of the locked positions.

To assure the escape of spent air from the forward working chamber it is preferable that grooves of unequal length be provided in the inner surface of the body at its rear end which form, in conjunction with the cylindrical surface of the large step of the striker, longitudinal passages of unequal length alternating along the circumference, so that when the striker is in either of said locked positions, its grooves open into these longitudinal passages of unequal length, the longitudinal grooves communicating with the shorter exhaust passages when the radial passage connects to a longer longitudinal inlet psassage during backward movement of the apparatus and with the longer exhaust passages during forward movement of the apparatus. Passages opening onto the rear end face of the body and into the space bound by the body, the rear end face of the large step of the striker and the cylindrical surface of its small step are provided in the rearward portion of the body.

For setting the striker into said locked positions it is preferable to incorporate into the apparatus a rotary sleeve located in the rearward portion of the apparatus and movably linked with the striker.

To assure the movable link between the striker and the sleeve it is preferable arrange the outer surface of the small step of the striker coaxially with the inner surface of the rotary sleeve and to displace the axes of both these surfaces parallel to the axis of the outer surface of the large step of the striker and that of the rotary sleeve by an equal amount of eccentricity. This plan is conducive to an improved economy of the apparatus, due to the minimization air leaks between the small step of the striker and the sleeve.

The present invention will now be described in detail by way of example with reference to the accompanying drawings in which:

Figures 1, 2:
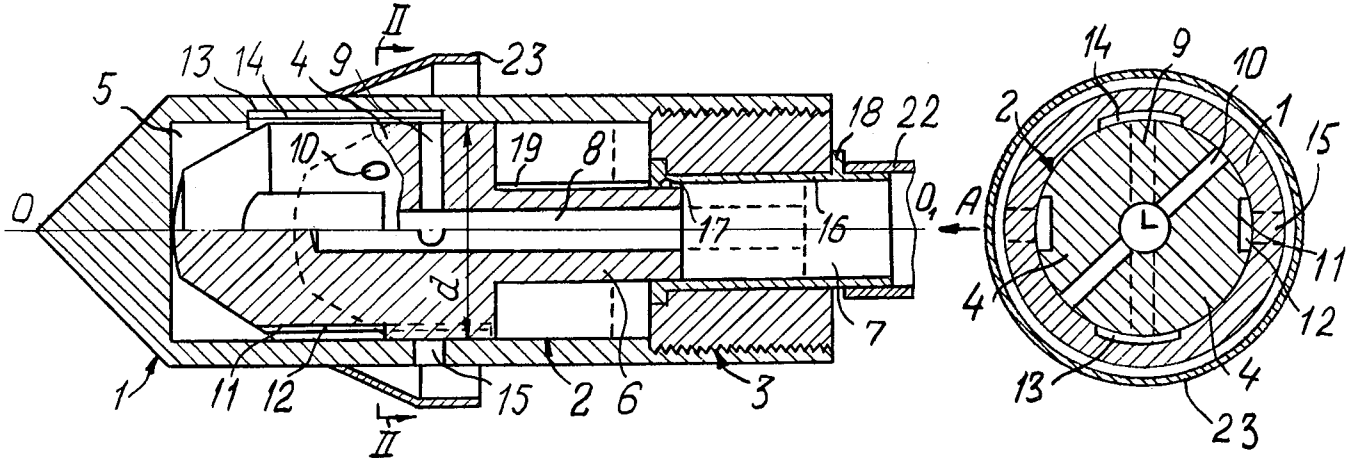
FIG. 1 is a longitudinal cross sectional view of the pneumatic apparatus of the percussive type for driving holes in the ground by compacting same, according to the invention; showing the striker in its foremost (upper portion of drawing) and rearmost (lower portion of drawing) positions during the forward movement of the apparatus.
FIG. 2 is a cross sectional view taken along the line II—II of FIG. 2.
Figure 4:
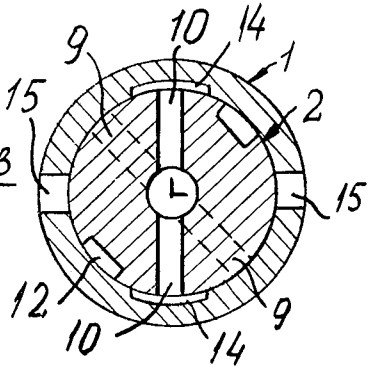
FIG. 4 is a cross sectional view taken along the line IV—IV of FIG. 3.
Figure 3:
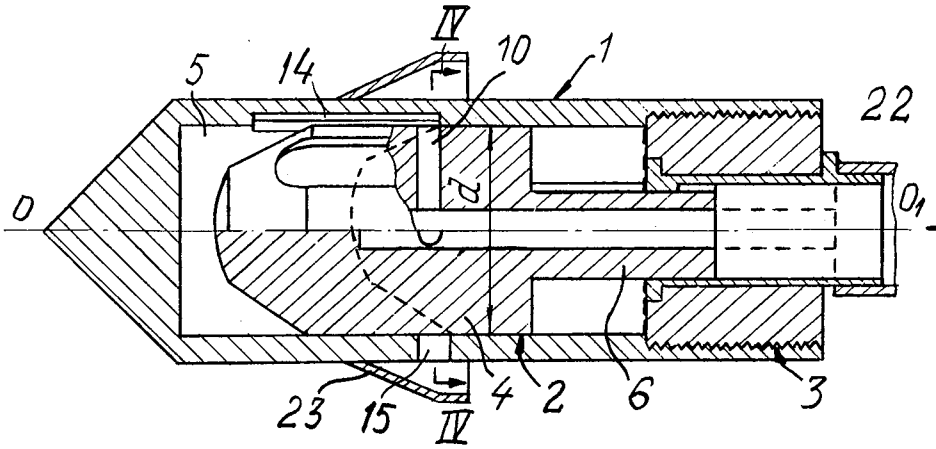
FIG. 3 is a longitudinal cross sectional view of the pneumatic apparatus of the percussive type for driving holes in the ground by compacting same, according to the invention; showing the striker in its foremost (upper portion of drawing) and rearmost (lower portion of drawing) positions during the backward movement of the apparatus.
Figure 5:
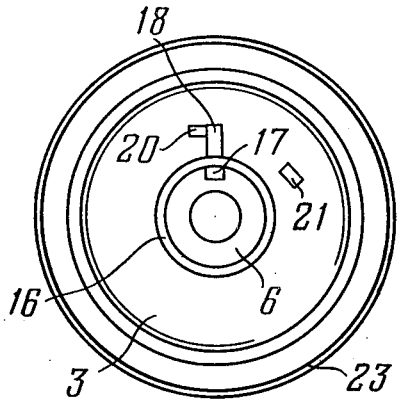
FIG. 5 is an end view of the apparatus in the direction of arrow A in FIG. 1.
Figure 6:
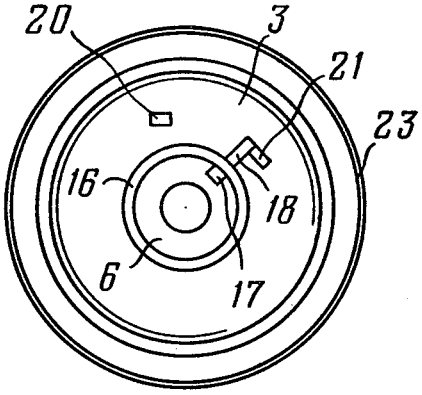
FIG. 6 is an end view of the apparatus in the direction of arrow B in FIG. 3.

Illustrated in FIGS. 1 through 6 is the first embodiment of the disclosed apparatus. The apparatus consists of a pointed-nose hollow cylindrical body 1 (FIG. 1), wherein is a stepped striker 2 is disposed. A nut 3 closing the bore of the body is accommodated in a rear portion of the body. A large step 4 of the striker 2 defines in conjunction with the body 1 a forward working chamber 5; and a small step 6 of the striker defines in conjunction with the nut 3 a rear working chamber 7. The striker 2 is provided with a central passage 8; a main radial passage 9 and an additional radial passage 10, both radial passages opening onto an outer cylindrical surface of the greater step 4 of the striker and into the central passage 8 (FIGS. 1 and 2). The radial passages 9 and 10 are displaced relative to each other both circumferentially and along an axis $O-O_1$ of the apparatus. Longitudinal grooves 11 communicating with the forward working chamber 5, located between the radial passages 9 and 10 and defining in conjunction with the body 1 passages 12 through which air is discharged from the forward working chamber 5, are provided in the outer surface of the greater step 4 of the striker 2 at its forward end (FIGS. 1 - 3). Longitudinal grooves 13 defining in conjunction with the outer cylindrical surface of the greater step 4 of the striker 2 passages 14 through which air is introduced into the forward working chamber 5, are provided in the inner surface of the body 1 at its forward end. The body 1 is also provided with ports 15 arranged behind the grooves 13 toward the rear end of the body through which air from the forward working chamber 5 is discharged.

To provide for forward and backward movement of the apparatus, the striker 2 can be set into two positions inside the body 1 where it is locked against rotation about its axis $0-O_1$. To that end, a rotary sleeve 16, which has a projection 17 on its inner surface and a projection 18 on its outer surface at the rear end, is fitted into the nut 3. The sleeve 16 is movably linked with the striker 2 by means of a groove 19 into which the projection 17 is fitted (FIG. 1).

For setting the striker 2 into the locked positions corresponding to the forward movement of the apparatus, when it is traveling in the direction of the hole and to the backward movement of the apparatus when it is traveling backward from the hole stops 20 and 21 (FIGS. 5 and 6) are provided on the outside end face of the nut 3.

Connected to the sleeve 16 is a hose 22 through which compressed air is introduced from a source of compressed air into the working chambers. A guard 23 is provided on the body 1 to prevent the fouling of the bore of the apparatus through the ports 15.

The apparatus operates according to the following principles.

When the apparatus is set to advance move forward, the projection 18 (FIGS. 1 and 2) of the sleeve 16 interacts with the stop 20 (FIG. 5) of the nut 3, and the striker 2 is locked against rotation about the axis $O-O_1$ of the body 1 in the position corresponding to forward movement of the apparatus. When the striker 2 is in its foremost position (FIGS. 1 and 2) the additional radial passage 10 is closed by the inner surface of the body 1, whereas the main radial passage 9 communicates with an inlet passage 14. At the same time, the ports 15 in the body 1 are closed by the cylindrical surface of the large step 4 of the striker 2. Compressed air admitted through the hose 22 enters the rear working chamber 7 which appears to be permanently connected to the source of compressed air, and then reaches the forward working chamber 5 through the central passage 8, the radial passage 9 and the inlet passage 14.

Since the working area of the striker 2 facing the forward working chamber 5 is greater than the working area facing the rear working chamber 7, compressed air causes the striker 2 to move toward the rear end of the apparatus, i.e., rightward in FIG. 1. When the striker arrives at a certain position, the radial passages 9 become closed by the inner surface of the body 1 and the striker 2 is urged to continue its travel by the energy of the air expanding in the forward working chamber 5. At the end of the backstroke of the striker 2 (FIG. 1), the forward working chamber 5 is connected to the atmosphere through the passages 12 and the port 15, thus enabling the air to escape. The striker 2 is stopped by the pressure of the air present in the rear working chamber 7 and then, yielding to this pressue, starts moving toward the forward portion of the apparatus and strikes against the body 1 so as to drive it into the ground upon reaching the foremost position. The cycle is repeated and the apparatus progresses through the ground due to the blows delivered by the striker. Any backward movement of the apparatus is prevented by the friction forces coming into play between the body 1 and the ground.

To reverse the direction of travel of the apparatus, the striker 2 (FIG. 4) is turned, by turning the hose 22 integrally with the rotary sleeve 16, into its second locked position in which the projection 18 (FIG. 6) of the sleeve 16 interacts with the stop 21 of the nut 3. Now, when the striker 2 (FIGS. 3 and 4) is in its foremost position, the additional radial passages 10 are connected to the inlet passages 14, the radial passages 9 are closed by the inner surface of the body 1 and the ports 15 in the body are closed by the outer cylindrical surface of the greater step 4 of the striker 2 with the result that compressed air is admitted into the forward working chamber 5. Since the additional radial passages 10 are located closer to the nose of the apparatus than the radial passages 9, the admission of compressed air into the forwad working chamber 5 takes place somewhat earlier than during the forward movement of the apparatus. Owing to that, the striker 2 is stopped by the pressure of compressed air in the forward working chamber without delivering the blow and then starts its backstroke. At the end of the backstroke of the striker 2, the large step 4 uncovers the ports 15 in the body but this uncovering and, consequently, the discharge of air from the forward working chamber takes place somewhat later than during the forward movement of the apparatus and, as a result, the striker strikes against the nut 3. The cycle is repeated and the blows delivered by the striker cause the apparatus to travel in a reverse direction.

An apparatus of the design described above combines the advantages of the prototype disclosed in the Belgic pat. No. 816,991—which are simplicity, operational reliability, durability and low labor requirements for manufacturing the apparatus—with the ability to travel in reverse.

In the description of other embodiments of the apparatus which follows all those elements which serve the same purpose and do not differ in design retain their original reference numerals, the elements differing in purpose and design being designated by adding the letter "*a*" to the corresponding reference numeral in describing the second embodiment and the letters "*b*" and "*c*", in describing the other embodiments.

Illustrated in FIGS. 7 through 14 is the second embodiment of the disclosed apparatus. This apparatus consists of a pointed-nose hollow cylindrical body 1*a* (FIGS. 7 and 11) in which a stepped striker 2*a* is disposed. A nut 3 closing the bore of the body 1*a* is accommodated in the body's rearward portion. A large step 4*a* of the striker 2*a* forms in conjunction with the body 1*a* a forward working chamber 5 and a small step 6 of the striker 2a forms in conjunction with the nut 3 a rear working chamber 7. The striker 2*a* is provided with a central passage 8 and with at least one radial passage 9 opening onto an outer cylindrical surface of the large step 4*a* of the striker 2*a* and into the central passage 8. Longitudinal grooves 11 communicating with the forward working chamber 5 and defining in conjunction with the body 1*a* passages 12 through which air is discharged from the forward working chamber 5, are provided in the outer surface of the large step 4*a* of the striker 2*a* at its forward end. Longitudinal grooves 24 and 25 of unequal length defining in conjunction with the outer cylindrical surface of the large step 4*a* of the striker 2*a* inlet passages 26 (FIG. 7) and 27 (FIG. 11) are provided in the inner surface of the body 1*a* at its forward end and are arranged alternately along its circumference. The body 1*a* is also provided with ports 15 (FIG. 7) arranged behind the grooves 24 and 25 toward the rear end of the body.

To provide for forward and backward movement of the apparatus, the striker 2*a* can be set into two positions inside the body 1*a* where it is locked against rotation about its axis $O-O_1$. To that end, a rotary sleeve 16; which has a projection 17 on its inner surface and a projection 18 on its outer surface at the rear end, is fitted into the nut 3. The sleeve 16 is movably linked with the striker 2*a* by means of a groove 19 into which the projection 17 is fitted.

For setting the striker into the locked positions corresponding to the forward and backward movement of the apparatus, stops 20 and 21 (FIGS. 5 and 6) are provided on the outer end face of the nut 3.

Compressed air is admitted into the working chambers through a hose 22 (FIGS. 7 and 11) attached to the sleeve 16 and connected to a source of compressed air (not shown). A guard 23 is provided on the body 1*a* to prevent the fouling of the bore of the apparatus through the ports 15.

The apparatus operates according to the following principles.

When the apparatus is set to advance move forward, the projection 18 (FIG. 6) of the sleeve 16 interacts with the stop 20 of the nut 3, and the striker 2*a* is in one of the positions wherein it is locked against rotation about the axis $0-O_1$ of the body 1*a*. When the striker 2*a* is in its foremost position (FIGS. 7 and 9), its radial passage 9 is connected to a shorter inlet passage 26 and the ports 15 in the body 1*a* are closed by the outer cylindrical surface of the large step 4*a* of the striker 2*a*. Compressed air admitted through the hose 22 enters the rear working chamber 7, which appears to be permanently connected to the source of compressed air, and then reaches the forward working chamber 5 through the central passage 8, the radial passage 9 and the inter passage 26.

Figure 7:
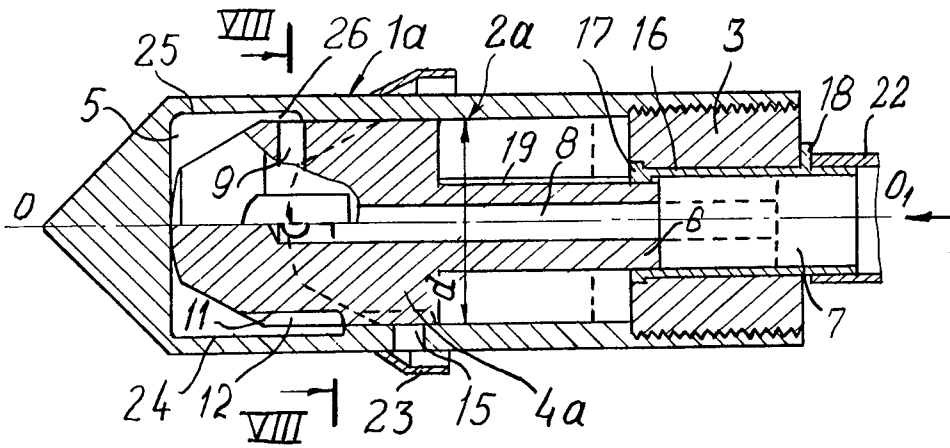
FIG. 7 is a longitudinal cross sectional view of the pneumatic apparatus of the percussive type for driving holes in the ground by compacting same, according to the invention wherein grooves of unequal length are provided in the forward portion of the body, showing the striker in its foremost (upper portion of drawing) and rearmost (lower portion of drawing) positions during the forward movement of the apparatus.
Figure 14:
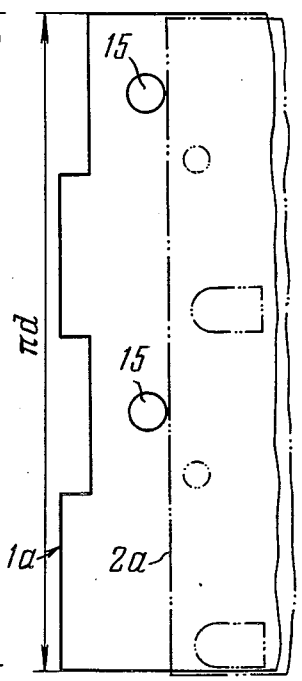
FIG. 14 is a view similar to FIG. 13 but with the striker in its rearmost position.
Figure 13:
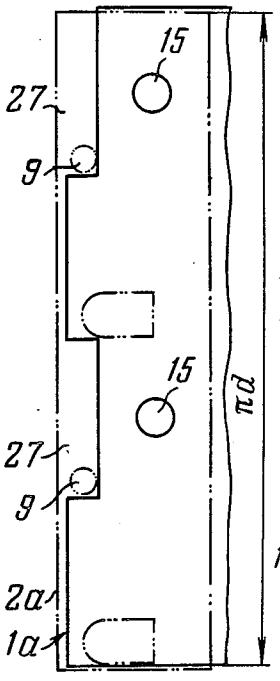
FIG. 13 is a view showing on a plane the forward portion of the inside surface of the body with a diameter of "*d*" in FIG. 11 overlaid by a view on a plane of the same portion of the outside surface of the large step of the striker 2*a* of the same diameter during the backward movement of the apparatus and with the striker in its foremost position.
Figure 10:
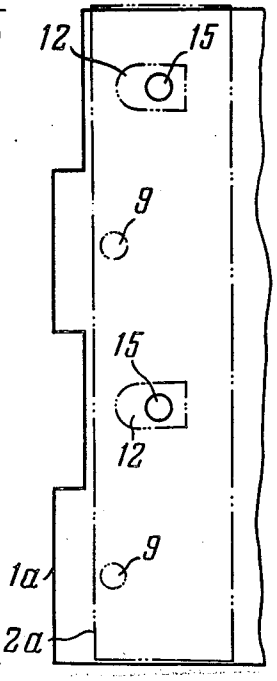
FIG. 10 is a view similar to FIG. 9 but with the striker in its rearmost position.
Figure 9:
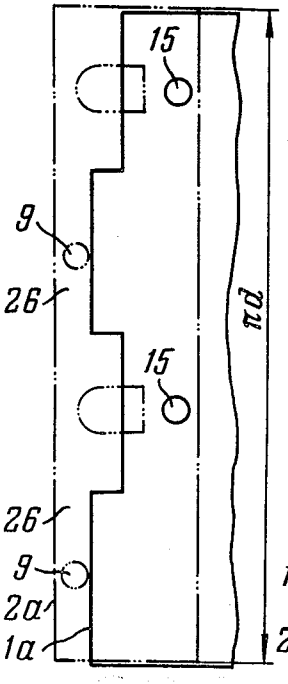
FIG. 9 is a view showing on a plane the forward portion of the inside surface of the body with a diameter of "*d*" in FIG. 7 overlaid by a view on a plane of the same portion of the outside surface of the large step of the striker of the same diameter during the forward movement of the apparatus and with the striker in its foremost position.
Figure 12:
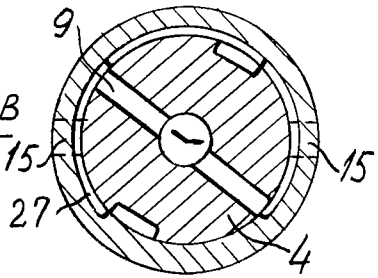
FIG. 12 is a cross sectional view taken along the line XII—XII of FIG. 11.
Figure 11:
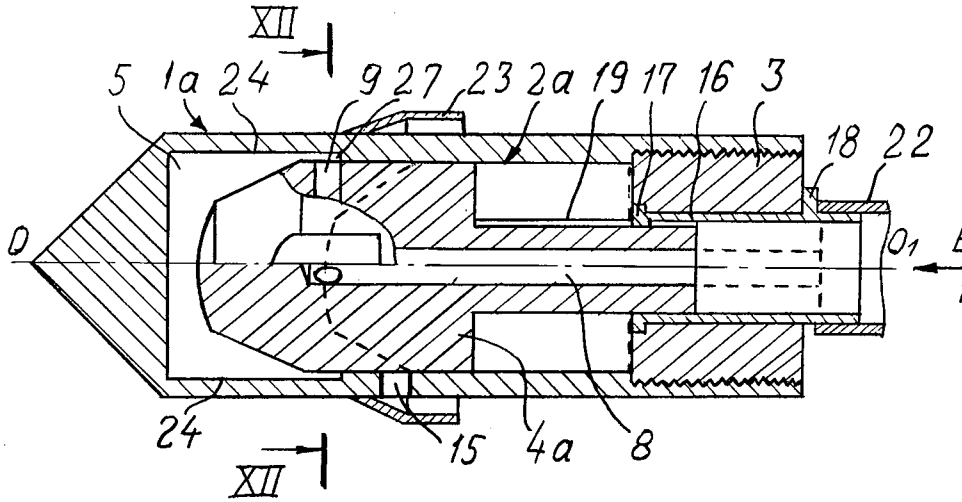
FIG. 11 is a longitudinal cross sectional view of the pneumatic apparatus of the percussive type for driving holes in the ground by compacting same, according to the invention wherein grooves of unequal length are provided in the forward portion of the body, showing the striker in its foremost (upper portion of drawing) and rearmost (lower portion of drawing) positions during the backward movement of the apparatus.

Since the working area of the striker 2a facing the forward working chamber 5 is greater than its working area facing the rear working chamber 7, the compressed air causes the striker 2*a* to move toward the rear end of the apparatus, i.e. rightward in FIGS. 7 and 9. When the striker 2*a* arrives into a certain position, its radial passages 9 become closed by the inner surface of the body 1*a* and the striker 2*a* is urged to continue its travel by the energy of the air expanding in the forward working chamber 5. At the end of the backstroke of the striker 2*a* (FIGS. 7 and 10), the forward working chamber 5 communicate with the atmosphere through the passages 12 and the ports 15, thus enabling air to escape. The striker 2a is stopped by the pressure of the air present in the rear working chamber 7 and then, yielding to this pressure, starts moving toward the forward portion of the apparatus and strikes against the body 1*a* so as to drive it into the ground on reaching the foremost position. The cycle is repeated and the apparatus progresses through the ground due to the blows delivered by the striker. Any backward movement of the apparatus due to the reacting forces is prevented by the friction forces coming into play between the side surface of the body 1a and the ground.

To reverse the direction of travel of the apparatus, the striker 2*a* (FIGS. 11 and 14) is turned, by turning the hose 22 integrally with the rotary sleeve 16, into its second locked position in which the projection 18 (FIG. 6) of the sleeve 16 interacts with the stop 21 of the nut 3. When the striker 2*a* is in its foremost position, its radial passage 9 is connected to a longer inlet passage 27 while the ports 15 in the body 1*a* are closed by the cylindrical surface of the large step 4*a* of the striker 2*a* with the result that compressed air is admitted into the forward working chamber 5. Since the radial passage 9 is connected to a longer inlet passage 27, the admission of compressed air into the forward working chamber 5 takes place somewhat earlier than during the forward movement of the apparatus. Owing to that, the striker 2*a* is stopped by the pressure of compressed air in the forward working chamber without delivering the blow against the body 1*a* and then starts its backstroke. At the end of the backstroke of the striker 2*a* (FIGS. 11 and 14), its large step 4*a* uncovers the ports 15 in the body but this uncovering and, consequently, the discharge of air from the forward working chamber 5 takes place somewhat later than during the forward movement of the apparatus and, as a result, the striker 2*a* strikes against the nut 3. The cycle is repeated and the blows delivered by the striker cause the apparatus to travel in reverse.

An apparatus of the design disclosed above dispenses with the additional radial passage 10 and thus provides a more simple device and one that is more readily manufactured.

Figures 15, 16:
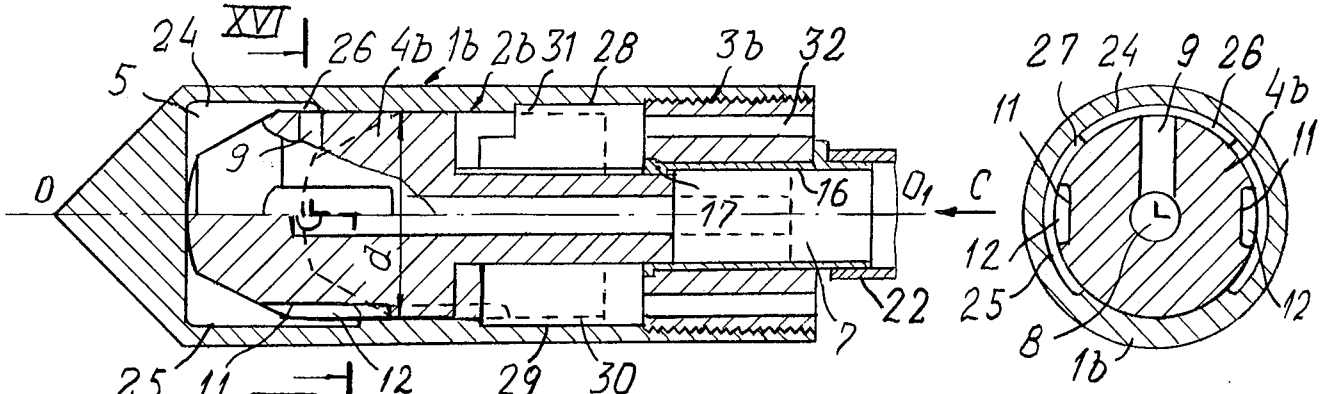
FIG. 15 is a longitudinal cross sectional view of the pneumatic apparatus of the percussive type for driving holes in the ground by compacting same, according to the invention; wherein grooves of unequal length are provided in the rearward portion of the body and the nut is provided with passages 32 for discharging air, showing the striker in its foremost (upper portion of drawing) and rearmost (lower portion of drawing) positions during the advance of the apparatus.
FIG. 16 is a cross sectional view taken along the line XVI—XVI of FIG. 15.

Referring to FIGS. 15 and 16, illustrated therein is an apparatus differing from those described above in the manner of discharging the air escaping from the apparatus through its rear end in this embodiment.

Figure 20:
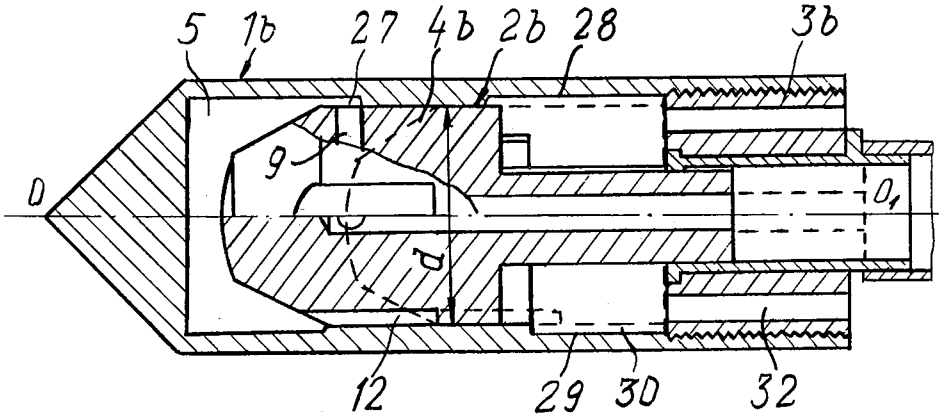
FIG. 20 is a longitudinal cross sectional view of the pneumatic apparatus of the percussive type for driving holes in the ground by compacting same, according to the invention. Wherein grooves on unequal length are provided in the rearward portion of the body and the nut is provided with passages for discharging air, showing the striker in its foremost (upper portion of drawing) and rearmost (lower portion of drawing) positions during the backward movement of the apparatus.

The apparatus consists of a pointed-nose cylindrical body 1*b* (FIG. 15) in which a stepped striker 2*b* is disposed. A nut 3*b* closing the bore of the body 1*b* is accommodated in its rear portion. A large step 4*b* of the striker 2*b* defines in conjunction with the body 1*b* a forward working chamber 5 and a small step 6 of the striker 2*b* defines in conjunction with the nut 3*b* a rear working chamber 7. The striker 2*a* is provided with a central passage 8 and with at least one radial passage 9 opening onto an outer cylindrical surface of the large step 4*b* of the striker 2*b* and into the central passage 8. Longitudinal grooves 11 communicating with the forward working chamber 5 and defining conjunction with the body 1*b* passages 12 from the forward working chamber 5, through which air is discharged are provided in the outer surface of the large step of the striker 2*b* at its forward end. Longitudinal grooves 24 and 25 of unequal length defining conjunction with the outer cylindrical surface of the large step 4*b* of the striker 2*b* inlet passages 26 (FIG. 15) and 27 (FIG. 20) are provided in the inner surface of the body 1*b* at its forward end and are arranged alternately along the circumference. Longitudinal grooves 28 and 29 (FIGS. 15 and 20) of unequal length defining in conjunction with the large step 4*b* of the striker 2*b* exhaust passages 30 and 31 are provided in the inner surface of the body 1*b* at its rear end and are arranged alternately around the circumference. The inlet passages 26 and 27 as well as the exhaust passages 30 and 31 are arranged so as to provide for the forward and backward movement of the apparatus.

To provide for the forward and backward movement of the apparatus, the striker 2*b* can be set into two positions inside the body 1*b* where it is locked against rotation about its axis $O-O_1$. To that end, a rotary sleeve 16 which has a projection 17 on its inner surface and a projection 18 on its outer surface at the rear end, is fitted into the nut 3*b*. The sleeve 16 is movably linked with the striker 3*b* by means of a groove 19 into which the projection 17 is fitted.

Figure 17:
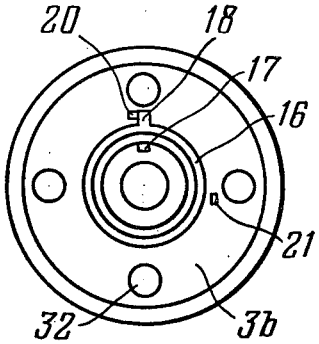
FIG. 17 is an end view of the apparatus in the direction of arrow C in FIG. 15.
Figure 8:
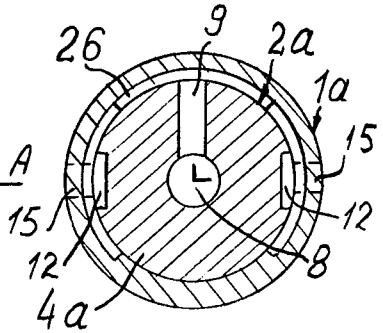
FIG. 8 is a cross sectional view taken along the line VIII—VIII of FIG. 7.
Figure 21:
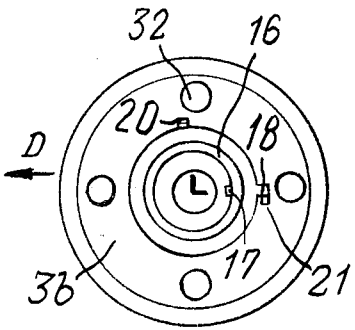
FIG. 21 is an end view of the apparatus in the direction of arrow D in FIG. 20.

For setting the striker 2*b* into the locked positions corresponding to the forward and backward movement the apparatus, stops 20 and 21 (FIGS. 17 and 21) are provided on the outer end face of the nut 3*b*.

Compressed air is admitted into the working chambers through a hose 22 attached to the sleeve 16 and connected to a source of compressed air (not shown). The nut 3*b* is provided with passages 31 (FIGS. 15 and 20) through which air is discharged from the forward working chamber 5 into the atmosphere.

Figure 19:
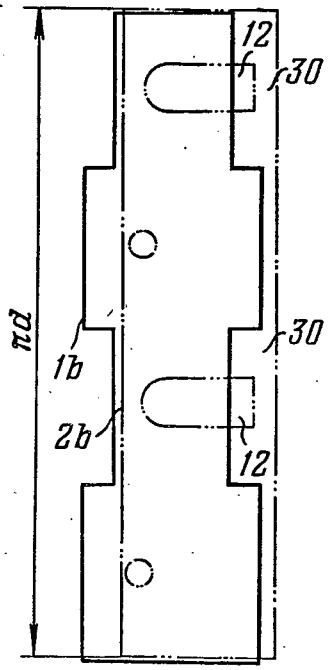
FIG. 19 is a view similar to FIG. 18 but with the striker in its rearmost position.
Figure 18:
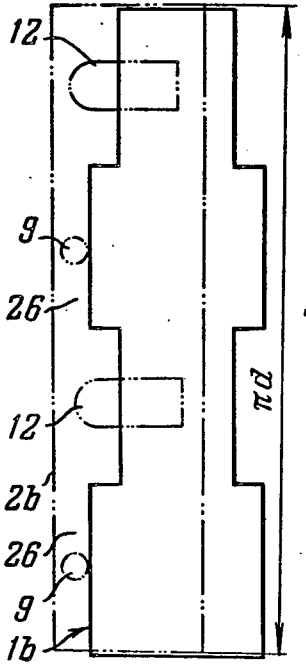
FIG. 18 is a view showing on a plane the forward portion of the inside surface of the body with a diameter of "*d*" in FIG. 15 overlaid by a view on the same plane of a portion of the outside surface of the large step of the striker of the same diameter during the forward movement of the apparatus and with the striker in its foremost position.

This embodiment of the apparatus operates in the same manner as the second embodiment except that the passages 12 of the striker 2*b* (FIGS. 15 and 19) become connected to the longer exhaust passages 30 at the end of the backstroke, whereby the forward working chamber 5 becomes connected to the atmosphere so that air may be discharged. The striker 2*b* is stopped by the pressure of the air present in the rear working chamber 7 and then, yielding to that pressure, starts moving toward the forward portion of the apparatus, and strikes against the body 1*b* so as to drive it into the ground on reaching the foremost position. The cycle is repeated and the apparatus progresses through the ground due to the blows delivered by the striker. Any backward movement of the apparatus due to the reacting forces is prevented by the friction forces coming into play between the side surface of the body and the ground.

Figure 23:
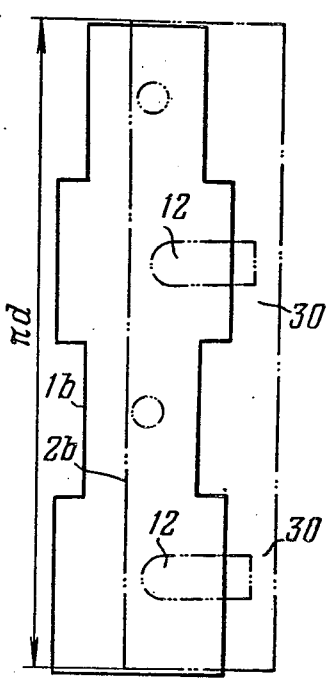
FIG. 23 is a view similar to FIG. 22 but with the striker in its rearmost position.
Figure 22:
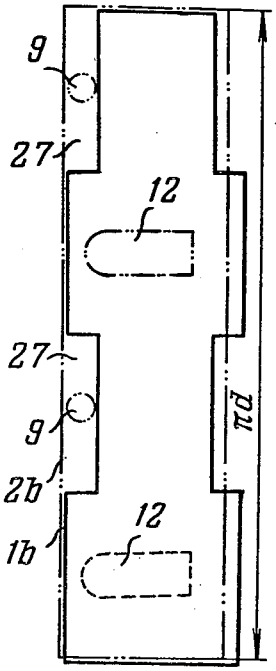
FIG. 22 is a view showing on a plane the forward portion of the inside surface of the body with a diameter of "d" in FIG. 20 overlaid by a view on a plane of the same portion of the outside surface of the large step of the striker of the same diameter during the backward movement of the apparatus and with the striker in its foremost position.

To reverse the direction of travel of the apparatus, the striker 2*b* (FIG. 20) is turned, by turning the hose 22 integrally with the rotary sleeve 16, into its second locked position in which the projection 18 of the sleeve 16 (FIG. 21) interacts with the stop 21 of the nut 3*b*. When the striker 2*b* is in its foremost position (FIGS. 20 and 22), its radial passage 9 is connected to a longer inlet passage 27 and the exhaust passages 12 are closed by the inner surface of the body 1*b* with the result that compressed air is admitted into the forward working chamber 5. Since the radial passage is connected to a longer inlet passage 27, the admission of compressed air into the forward working chamber 5 takes place somewhat earlier than during the forward movement of the apparatus. Owing to that, the striker 2*b* is stopped by the pressure of compressed air without delivering the blow against the body 1*b* and then starts its backstroke, moving rightward in FIG. 20. At the end of the backstroke of the striker 2*b* (FIGS. 20 and 23) its passage 20 opens into a shorter exhaust passage 30, thus connecting the forward working chamber to the atmosphere, but the opening of the passage 20 and, consequently, the discharge of air from the forward working chamber occurs somewhat later than during the forward movement of the apparatus with the result that the striker 2*b* strikes against the nut 3*b*. The cycle is repeater and the blows delivered by the striker cause the apparatus to travel in reverse.

This embodiment of the apparatus dispenses with the ports in the side wall of the body 1*b* and displays, in consequence, a higher strength. In addition, its is capable of a higher rate of penetration due to a higher unit power applied per unit area of the cross section of the hole, this being obviously a fact because the apparatus dispenses with the guard which adds to its diameter.

Figure 24:
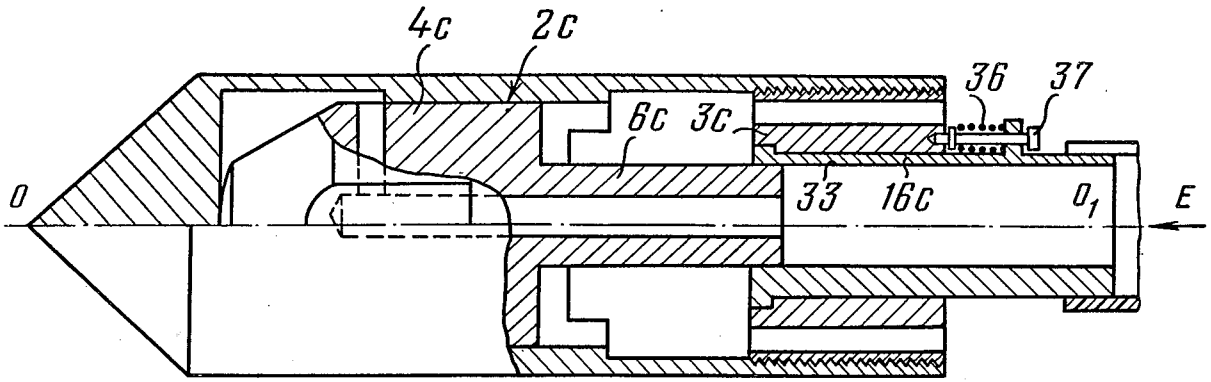
FIG. 24 is a longitudinal cross sectional view of the pneumatic apparatus of the percussive type for driving holes in the ground by compacting same, according to the invention. wherein the outside surface of the small step of the striker is arranged coaxially with the inside surface of the rotary sleeve and the axes of both these surface are displaced parallel to the axis of the outside surface of the large step of the striker and that of the sleeve by a certain amount of eccentricity.
Figure 26:
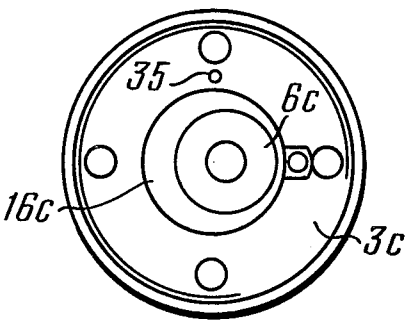
FIG. 26 is a view similar to FIG. 25 but when the apparatus is travelling in the reverse direction.
Figure 25:
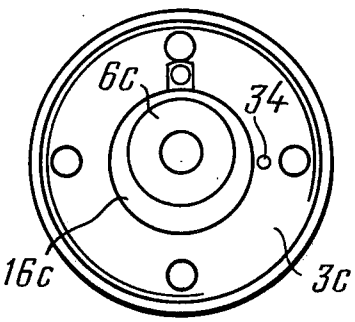
FIG. 25 is an end of the apparatus in the direction of arrow E in FIG. 24

Illustrated in FIG. 24 is an apparatus wherein, unlike the apparatus described above, the movable link between the striker and rotary sleeve is effected without the splined joint. To that end, the outer cylindrical surface of the small step 6*c* of the striker 2*c* and the inner surface 33 of the rotary sleeve 16*c* are arranged coaxially but at the same time their axes are displaced parallel to the axis $O-O_1$ of the outer surface of the large step 4*c* of the striker 2*c* and that of the rotary sleeve 16*c* by an equal amount of eccentricity. The outer end face of the nut 3*c* (FIGS. 25 and 26) is provided with recesses 34 and 35 and the rotary sleeve 16*c* is provided with a horizontal pin 37 (FIG. 24) acted upon by a spring 36.

When the apparatus is moving forward, the pin 37 engages the recess 35. For reversing the travel of the apparatus, the hose 22 is turned so that the springloaded pin 37 leaves the recess 35 and then the sleeve 16c is further turned through an angle which enables the pin 37 to engage the recess 34 in the nut 3c. Since the outer cylindrical surface of the small step 6c of the striker 2c and the inner surface 33 of the rotary sleeve 16c are coaxially aligned whereas their axes are displaced parallel to the axis $O-O_1$ of the outer surface of the large step 4c of the striker 2c and of that of the rotary sleeve 16c by an equal amount of eccentricity, the striker 2c will turn in the body 1c about its axis simultaneously with the sleeve 16c and through the same angle as the sleeve 16c with the result that the apparatus will travel in reverse.

This embodiment of the apparatus is characterized by good economy of its operation because strong air leaks commonly experienced through the splined joint are eliminated.

The apparatus disclosed is of simple design, reliable in operation and capable of reversing the direction of its travel without malfunctioning. Practical tests have proved its advantages.

What is claimed is:

1. A pneumatic apparatus of the percussive type for driving holes in the ground by compacting same comprising a pointed-nose hollow cylindrical body closed at the back and provided with grooves in the inner surface of its forward portion; a stepped striker disposed in said body so as to enable reciprocation by the action of compressed air, a forward working chamber being defined by said body and said striker, said forward working chamber recurrently connecting to a source of compressed air and to the atmosphere for discharging air, a rear working chamber defined by said body and said striker, said rear working chamber being permanently connected to the source of compressed air, a space defined by a rear end face of a large step of said striker, a cylindrical surface of the small step of said striker and said body, said striker being provided with a central passage connected to the rear working chamber and with at least two radial passages which open into said central passage and onto an outer cylindrical surface of the large step of said striker, the radial passages being displaced relative to each other circumferentially and longitudinally along the axis of said body, said striker being disposed in said body so as to enable rotation about the axis of said body and so as to be set into either of two locked positions relative to said body wherein rotation about the axis of said body is prevented, the locked positions corresponding to forward and backward movement of said apparatus, passages for introducing compressed air into said forward working chamber being defined by the outer cylindrical surface of the larger step of said striker and by grooves in said body, ports provided in the side wall of said body at its rear end between the radial passages of said striker for the discharge of air from said forward working chamber; a means of performing the control rotation of said striker in said body about the axis thereof and of locking the striker in either of the two said locking positions, in each of said locked positions one of the radial passages of said striker is connected to the passages defined by the outer cylindrical surface of the large step of said striker and the grooves in said body for admitting compressed air into the forward working chamber.

2. An apparatus as claimed in claim 1, further comprising a rotary sleeve by means of which said striker is set into said locked positions provided in the rearward portion of said body and movably linked with said striker.

3. A pneumatic apparatus of the percussive type for driving holes in the ground by compacting same comprising a pointed-nose hollow cylindrical body closed at the back and provided with grooves in the inner surface of its forward portion; a stepped striker disposed in said body so as to enable reciprocation by the action of compressed air, a forward working chamber defined by said body and said striker, said forward working chamber recurrently connecting to a source of compressed air and to the atmosphere for discharging air, a rear working chamber defined by said body and said striker, said rear working chamber being permanently connected to the source of compressed air, a space defined by a rear end face of a large step of said striker, a cylindrical surface of the small step of said striker and by said body, said striker being provided with a central passage connected to said rear working chamber and with at least one radial passage opening into said central passage and onto an outer cylindrical surface of the large step of said striker, said striker being disposed in said body so as to enable setting it into either of two locked positions relative to said body wherein rotation about the axis of said body is prevented, the locked positions corresponding to forward and backward movement of said apparatus, said striker being provided with longitudinal grooves in the outer surface of the forward portion of the large step which define passages in conjunction with said body through which air is discharged from said forward working chamber, said body being provided with grooves of unequal length in the inner surface of its forward portion which define in conjunction with the outer cylindrical surface of the large step of said striker passages of unequal length through which air is admitted into said forward working chamber, said passages alternating along the circumference so that the radial passage in said striker opens into said passages of unequal length when said striker is in either of said locked positions; a means of performing the control rotation of said striker in said body about the axis thereof and of locking the striker in either of the two said locking positions.

4. A pneumatic apparatus as claimed in claim 3 wherein grooves of unequal length, for the discharge of air from said forward working chamber, are provided in the inner surface of said body at its rear end so as to define, in conjunction with the cylindrical surface of the large step of said striker, longitudinal passages of unequal length alternating along the circumference, so that when said striker is in either of said locked positions its grooves open into these longitudinal passages of unequal length, the longitudinal grooves in the outer surface of the large step of said striker at its forward end being connected to the shorter exhaust passages when the radial passage of said striker is connected to a longer inlet passage during the backward movement of said apparatus and to the longer exhaust passages during the forward movement of said apparatus, passages being provided in the rear portion of said body opening onto its rear end face and into the space defined by the rear end face of the oarge step of said striker, the cylindrical surface of the small step of said striker and said body.

5. An apparatus as claimed in claim 3, further comprising a rotary sleeve by means of which said striker is set into said locked positions provided in the rear portion of said body and movably linked with said striker.

6. An apparatus as claimed in claim 5, wherein, for assuring the movable link between said striker and said sleeve, the outer surface of the small step of said striker is arranged coaxially with the inner surface of said rotary sleeve and the axes of these surfaces are displaced parallel to the axis of the outer surface of the large step of said striker and that of said rotary sleeve by an equal amount of eccentricity.

* * * * *